United States Patent [19]

Fischer

[11] Patent Number: 4,554,870

[45] Date of Patent: Nov. 26, 1985

[54] INK METERING DEVICE FOR A PRINTING MACHINE HAVING AN INK TROUGH-INK ROLLER COMBINATION

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 586,689

[22] Filed: Mar. 6, 1984

[30] Foreign Application Priority Data

Mar. 8, 1983 [DE] Fed. Rep. of Germany ..... 3308066

[51] Int. Cl.[4] ..... B41F 31/12

[52] U.S. Cl. ..... 101/365; 101/350; 101/356; 101/360

[58] Field of Search ..... 73/290 R; 141/94; 222/DIG. 1, 57; 101/335, 350, 356, 360

[56] References Cited

U.S. PATENT DOCUMENTS

| | | | |
|---|---|---|---|
| 3,185,987 | 5/1965 | Miyagawa et al. | 73/290 R X |
| 3,399,652 | 9/1968 | Gawron et al. | 222/57 X |
| 3,404,901 | 11/1968 | Dost et al. | 222/DIG. 1 |
| 3,572,551 | 3/1971 | Gillespie et al. | 222/DIG. 1 |
| 3,572,555 | 3/1971 | Knight et al. | 222/DIG. 1 |
| 3,631,800 | 1/1972 | Mignone et al. | 222/DIG. 1 |
| 3,632,019 | 1/1972 | Harm | 222/DIG. 1 |
| 4,331,184 | 5/1982 | Terashima et al. | 141/94 |
| 4,373,445 | 2/1983 | Köbler | 101/365 |
| 4,402,264 | 9/1983 | Weisgerber | 101/365 |
| 4,485,738 | 12/1984 | Gertsch et al. | 101/365 |

FOREIGN PATENT DOCUMENTS

| | | |
|---|---|---|
| 0120833 | 5/1976 | Fed. Rep. of Germany . |
| 2648098 | 4/1979 | Fed. Rep. of Germany . |

OTHER PUBLICATIONS

"Machine Printing" by W. R. Durrant et al., (Design of Inking Systems–p. 75), ©1973.

*Primary Examiner*—Daniel M. Yasich

*Attorney, Agent, or Firm*—Frishauf, Holtz, Goodman & Woodward

[57] ABSTRACT

In an ink metering device for an ink trough—ink roller combination, circular-cylindrical buttons rotatably inserted into the bottom plate of the ink trough are used as ink metering elements. One face end of the buttons has raised projections acting as metering ridges, which are either in contact with the ink roller 2 or spaced apart therefrom by a specific distance. The projections acting as metering ridges preferably extend diametrically across the face end of each metering element. By rotating the metering elements about their axis of rotation, which is approximately perpendicular to a tangent of the ink roller, the ink metering can thus be varied from a minimum amount (zero) to a maximum (for complete inking), depending on the rotational position of the raised projections.

12 Claims, 4 Drawing Figures

INK METERING DEVICE FOR A PRINTING MACHINE HAVING AN INK TROUGH-INK ROLLER COMBINATION

The invention relates to printing machines, and more particularly to an ink metering device for an ink trough—ink roller combination therein, especially for flat bed or high pressure rotary printing machines, having rotatable metering elements of the width of an ink zone and comprising circular buttons on the ink trough roller.

BACKGROUND

From German Democratic Republic Patent DD-PS 120 833, longitudinally displaceable metering tongues or strips are known. The strips have the width of an ink zone and can be pressed continuously against the ink roller. Viewed in the axial direction of the ink roller supporting and metering zones are thereby provided. The ink metering is effected by means of wedge-shaped recesses in the tongues.

From German Examined Patent Application DE-AS No. 26 48 098, an ink metering device of the general type described above is known, in which each metering element for inking zones has supporting and metering zones located beside one another, viewed in the axial direction of the ink trough roller. Each metering element is pressed continuously by spring pressure, with its supporting zones against the ink trough roller. The metering zones, each located between two supporting zones, extend in wedge-like fashion in depth, so that by rotating the supporting elements about their axis of rotation parallel to the ink roller, coats of ink of different thicknesses away be produced on the ink roller. One disadvantage of this system is that the manufacture of such metering elements is expensive; another is that the continuous contact of the supporting zones with the ink roller leaves relatively wide areas that cannot be inked, which in turn makes it more difficult to distribute or attain a uniform coating of ink to be transferred from the roller. In the system known from German Democratic Republic Patent DD-PS No. 120 833, the ink transfer is accomplished by means of regulating the width, and in the system of German Examined Patent Application DE-AS No. 26 48 098, the same principle is used in regulating the thickness of the ink coatings to be transferred.

THE INVENTION

It is accordingly an object of the present invention to create an ink metering system having ink metering elements that are simple to manufacture, and wherein, if necessary, an approximately complete inking of the ink trough roller is attainable.

Briefly, a plurality of closely adjacently located, essentially cylindrical ink measuring buttons are positioned in the bottom wall of the ink trough, close to the lower terminal edge of the surface adjacent the ink roller. The ink measuring buttons, in accordance with the invention, and facing the ink roller, are formed with an upwardly extending or raised projection, for example in the form of a transverse strip, a double-wedge-shaped raised section, or a double-butterfly or flat hyperbolic section, when looked at in plan view. The buttons are rotatably retained in the bottom wall of the ink trough, for rotation about an axis which is approximately perpendicular to a tangent of the ink roller. Upon rotation of the buttons, more or less ink is permitted to pass in the gaps between adjacent ridges, thus accurately metering the amount of ink being applied to the roller. Maximum ink flow is permitted when the raised projections, for example, have their major extent parallel to a circumferential line around the roller; ink flow is practically completely inhibited if the raised projections are aligned essentially axially parallel to the axis of rotation of the roller.

DRAWINGS

FIG. 1 shows an ink trough having the ink metering system according to the invention; and FIGS. 2–4 show ink measuring buttons having various shapes of upwardly extending projections.

DETAILED DESCRIPTION

Figure 1:
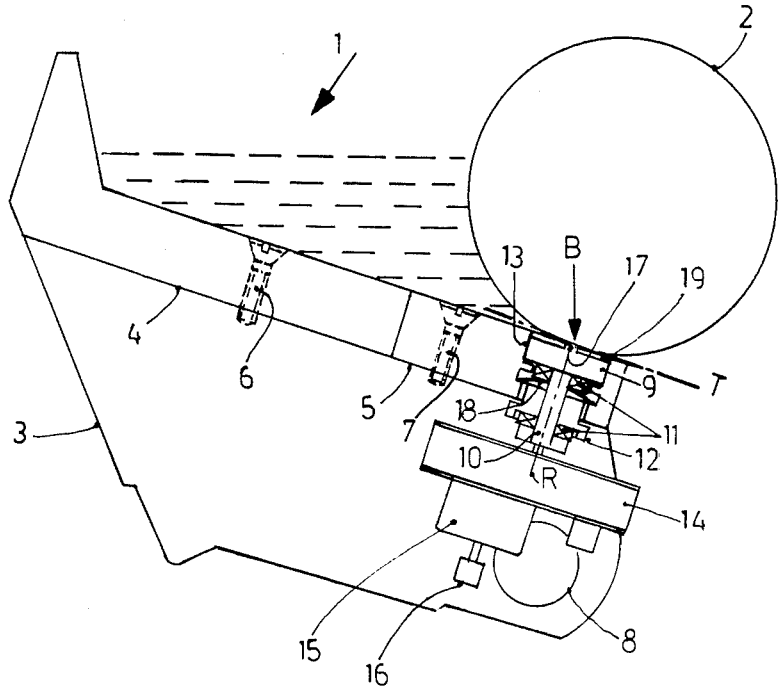

The invention will now be explained in terms of an ink trough 1 shown in FIG. 1, in which the front is defined by an ink roller 2 and which includes a cross brace or cross rail 3 as well as bottom walls 4, 5 disposed thereon. It will be understood, however, that the ink metering system according to the invention is also applicable to other types of ink troughs, such as those in which the ink roller becomes immersed, and that the ink measuring buttons according to the invention may also be disposed at other locations on the ink trough—ink roller combination.

The rear bottom wall 4 is secured to the cross brace 3 by means of screws 6, and the front bottom wall 5, near the ink roller, is secured to the cross brace 3 by means of screws 7. By loosening the screws 6, 7, the bottom walls 4, 5 can thus be removed easily. The ink trough 1 is pivotable about a shaft 8.

The ink metering elements 9, or ink measuring buttons, according to the invention are disposed in the front bottom wall 5. The ink metering elements 9 each comprise a circular-cylindrical body, on which a shaft is secured, preferably for its rotation about its axis of rotation R. Naturally the shaft 10 and the circular-cylindrical bodies of the ink metering elements 9 may be economically fabricated in one piece, for instance a turned part. At least one bearing 11 is disposed on the shaft 10 and is engaged by a lock nut 12 encompassing the shaft 10. The lock nut 12 can be threaded into the front bottom wall 5 from underneath, thereby enabling the desired shaft in the height of the measuring button 9, so as to space the measuring button apart from the ink roller 2 by a specified distance.

In the form of embodiment shown in FIGS. 1–4, the metering elements shown are inserted into bores 13. In order to enable the most complete possible inking of the ink roller 2, the spacing between adjacent bores 13 should be kept as small as possible, for instance 2 mm. Adjacent ink measuring buttons 9 may even be in contact with one another.

The shaft 10 of each measuring button 9 is connected to a gearing 14, which can be actuated either by a preferably remote-controlled motor 15 or manually by means of an ink zone set screw 16, so as to rotate each ink measuring button 9 about its axis of rotation R in the bore 13. This axis of rotation R must be approximately perpendicular to a tangent T of the ink roller 2.

According to the invention, a raised projection 17 formed as a metering ridge is provided on the face end of each ink measuring button 9. In order to enable an accurate zero position, for instance when the ink roller 2 comes to a stop, the metering ridges or projections 17 should each extend diametrically across the end face of the measuring button 9; that is, they should reach from an end portion of one side to the other, passing substantially through the center. In the form of embodiment shown in FIG. 1, a spring 18, preferably a plate spring, is provided between the lock nut 12, which encompasses the shaft 10 of an ink measuring button 9 and is threadable into the front bottom wall 5, and the circular-cylindrical body of the metering element 9. By means of this spring 18, the metering element 9, or the raised projection 17 provided on its end face and acting as a metering ridge, can be pressed resiliently against the ink roller 2. As a result, non-concentric operation of the ink roller can advantageously be compensated for. If a further bearing 11 is used, it is also possible to eliminate the spring 18 and to position the ink metering elements 9 at specific distances from the surface of the ink roller 2; this spacing can be selected such that, for instance, the raised projections 17 just touch the ink roller 2. If for instance a thin film of ink, one not having any harmful effect, is allowed to pass through between the projections 17 and the ink roller 2, then this film can act as a "lubricating film", thereby preventing wear. This effect can be still further improved by forming the surfaces of the raised projections 17 in a microroughened manner.

Figure 2:
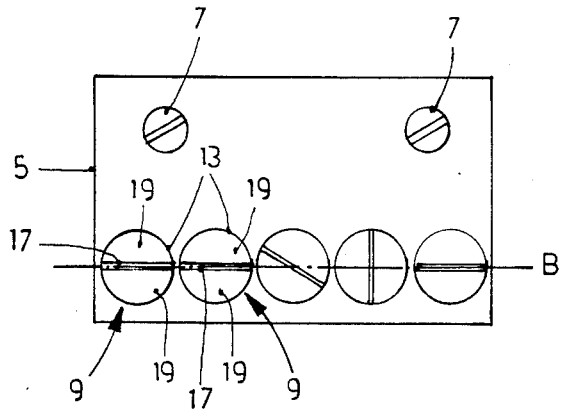

As shown by FIG. 1 considered together with FIG. 2, indentations 19 are provided at either side of each projection 17, by way of which indentations 19 ink can escape when an ink measuring button 9 is turned by the motor 15 or the ink zone set screw 16 such that the projections 17 no longer come to rest parallel with the ink trough contact line B—that is, if the ink measuring buttons 9 are rotated about their axes of rotation R. In the view shown in FIG. 2, the two left ink measuring buttons 9 and the right ink measuring button 9 are shown in the blocking position, while the ink measuring button 9 that is located second from the right is in the fully opened position, and the middle ink measuring button 9 is shown in a slightly opened position.

Because of the indentations provided at either side of the raised projections 17, it is thus possible to meter the width of the ink passing and indentations 19 and being applied to the roller 2. The raised projections 17 should preferably be kept as narrow as possible, so that in cases of maximum ink requirement (the perpendicular position with respect to the line of contact B), an approximately complete inking of the ink roller 2 can be accomplished. In the form of embodiment shown in FIG. 1, the indentations 19 are slightly countersunk in the bores. Should it be necessary to change the ink or to clean the metering device, either the front and rear bottom walls 4, 5 or only the front bottom wall 5 may be unscrewed and the entire ink metering device removed for the ink trough 1 for cleaning. The raised projections 17 of the ink measuring buttons 9 may optionally be made of some elastic material, such as hard rubber or plastic, which is particularly non-damaging to the surface of the ink roller 2.

Each of the ink measuring buttons shown in FIG. 2 can be adjusted in accordance with the zonal ink requirement to a corresponding position, which as already mentioned can be accomplished either with the motor 15 via remote control or manually with the ink zone set screws 16.

A further mode of operation is attainable by providing that the individual ink metering elements 9 be driven at different speeds by the respective motor 15 assigned to each of them; ink metering is again possible by this means, and at the same time a certain frictional ink-distributing effect and a certain amount of continuous cleaning are accomplished. The hydrodynamic pressure varies as a result, thereby enabling a cleaning effect.

Figure 3:
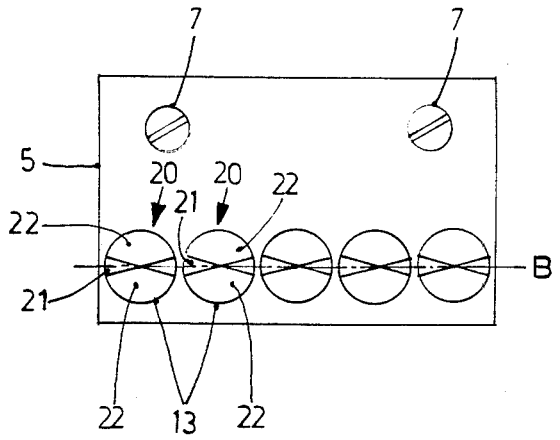
Figure 4:
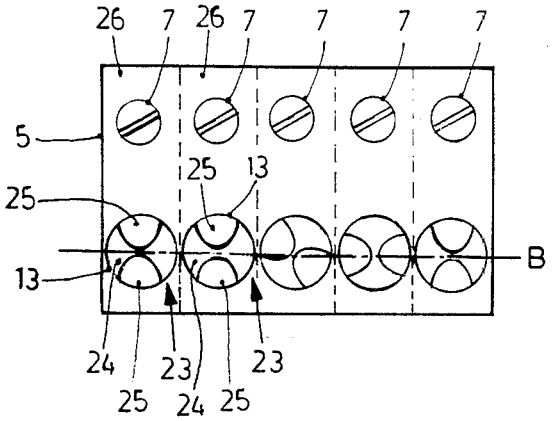

Further possible realizations of the raised projections provided on the face end of each ink metering element are shown in FIGS. 3 and 4 in schematic fashion. The metering elements 20 shown in FIG. 3 have raised projections 21 and at either side thereof indentations 22. The projections 21 comprise two triangles, the apexes of which meet at the center.

FIG. 4 shows a further very advantageous form of embodying the raised projections acting as metering ridges. The ink metering elements 23 shown in FIG. 4 again have continuous projections 24 and indentations 25 at either side of the projections 24. The lateral limitations of the projections 24 are here embodied in approximately semicircular or parabolic fashion. As a result, the angle of rotation of the ink metering elements 23 can be brought into an advantageous relationship with the amount of ink allowed to pass through as a result of the rotation for the purpose of ink metering. It is furthermore attained by the advantageous embodiment of the raised projections 24 that when the ink metering elements 23 are rotated out of the closed state, an area of increased width on the raised projections 24 very quickly appears at the line of contact B, which is advantageous in terms of the effects of wear on the ink roller. In order then to enable the most complete possible inking of the ink roller 2, the ridge in the middle should be very narrow in the form of embodiment shown in FIGS. 3 and 4, so that in the opened state (FIG. 2, second ink metering element from the right), only a very slight non-inkable area remains, one which virtually has no effect on the inking.

It will be understood that the various inking and positioning characteristics can be influenced individually without departing from the scope of the invention, by means of the various forms of embodiment of the raised projections which act as metering ridges and of the indentations adjoining them.

I claim:

1. In a printing machine, an ink metering device for an ink trough—ink roller combination of an inker, especially for an inker of a flat-bed or a high-pressure rotary printing machine, for controlling application of ink from the ink trough (1) to the ink roller (2) in axial zones having a plurality of rotatable metering elements (9) which are located close to each other, and each extends over the width of an ink zone, wherein said metering elements are formed as circular-cylindrical bodies, tangentially engageable against the ink roller (2);

each metering element (9) has an essentially planar end face which faces the ink roller (2), and at least one raised projection (17) extending across from one end portion to a second end portion of the planar end face and acting as a metering ridge;

and means (4, 5) are provided for supporting each of the metering elements for rotation about an axis of rotation (R) which is approximately perpendicular to a theoretical line which extends tangentially (T) with respect to the ink roller (2).

2. Device according to claim 1, wherein the raised projection (17) of at least one of the metering elements (9) extends diametrically across the face of the respective metering element with at least a portion through the center and forms the metering ridge.

3. Device according to claim 2, wherein the raised projection (17) extending from the planar end face of at least one of the metering elements comprises a narrow strip.

4. Device according to claim 3, wherein the terminal end portions of the raised projections (24) at either side—with respect to the center of the end face of the cylindrical body—of at least one of the metering elements, has an approximately semicircular or parabolic shape.

5. Device according to claim 3, wherein the raised projection of at least one of the metering elements (9) extends in the form of two triangles which meet essentially centrally in the end face of the respective elements with their apexes.

6. Device according to claim 1, wherein the raised projection of at least one of the metering elements comprises an elastic material.

7. Device according to claim 6, wherein the elastic material comprises at least one of: hard rubber; plastic.

8. Device according to claim 1, wherein the means (4, 5) for supporting the metering elements comprises a support plate (5);

counter-sunk bores (13) formed in the support plate;

and wherein the metering elements include a head portion fitted in the counter-sunk bores and carrying said essentially planar end face, said head portions being fitted in the counter sink of the counter-sunk bores.

9. Device according to claim 1, wherein at least one of the metering elements (9) includes a shaft (10) projecting therefrom in a direction opposite the essentially planar end face; and a gear arrangement (14) rotatably engaging said shaft (10).

10. Device according to claim 9, further including a motor (15) coupled to the gearing to rotate the shaft (10) and hence the respective alignment of the raised projection with respect to the surface of the roller (2) at the location of said theoretical tangential line.

11. Device according to claim 9, wherein the support means further include a needle bearing (11) on the shaft (10);

a spring (18) engaging the element (9) and tending to bias the element towards the outer surface of the roller (2);

and a lock nut (12) engaging the shaft (10) and engaging the spring (18), the lock nut (12) being accessible from beneath the support means and remote from the essentially planar end face of the metering element.

12. Printing ink supply metering system in and for combination with a printing machine, particularly a flat-bed or high-pressure rotary printing machine, comprising an ink trough (1, 3, 4) including a forwardly inclined bottom wall (4, 5);

a cylindrical ink roller (2) positioned to place the circumferential portion thereof adjacent a lower terminal edge of the bottom wall of the trough;

and a plurality of cylindrical ink metering buttons (9) located adjacent the roller on the bottom wall and close to the lower terminal edge thereof, wherein the upper surfaces of the ink measuring buttons (9) and facing the adjacent surface of the ink roller (2) are formed with an upwardly extending or raised projection thereacross (17);

wherein said buttons (9) are rotatably retained and supported for rotation about an axis (R) which is at least approximately perpendicular to a theoretical line (T) which is tangential with respect to the ink roller (2);

and wherein said buttons extend beneath the forwardly inclined bottom wall and are engageable externally thereof and beneath the ink trough for selected rotation about said axis of rotation (R) to thereby selectively change the position of the raised projection with respect to an axial line at the surface of the ink roller (2) and thus control ink flow from the ink trough to the surface of the ink roller.

* * * * *

UNITED STATES PATENT AND TRADEMARK OFFICE

CERTIFICATE OF CORRECTION

PATENT NO. : 4,554,870

DATED : November 26, 1985

INVENTOR(S) : Hermann FISCHER

It is certified that error appears in the above-identified patent and that said Letters Patent is hereby corrected as shown below:

Claim 4, line 1 (column 5, line 7) change "claim 3" to -- claim 2 --

Claim 5, line 1 (column 5, line 13) change "claim 3" to -- claim 2 --

Signed and Sealed this

*Eleventh* Day of *March 1986*

[SEAL]

*Attest:*

DONALD J. QUIGG

*Attesting Officer*

*Commissioner of Patents and Trademarks*